US010187723B2

(12) United States Patent
Sannie et al.

(10) Patent No.: US 10,187,723 B2
(45) Date of Patent: Jan. 22, 2019

(54) AUDIO PROCESSING DEVICE

(75) Inventors: Antoine Sannie, Paris (FR); Manuel De La Fuente, Paris (FR); Pierre-Emmanuel Calmel, Versailles (FR)

(73) Assignee: DEVIALET, Paris (FR)

( * ) Notice: Subject to any disclaimer, the term of this patent is extended or adjusted under 35 U.S.C. 154(b) by 796 days.

(21) Appl. No.: 13/980,084

(22) PCT Filed: Jan. 19, 2012

(86) PCT No.: PCT/EP2012/050792

§ 371 (c)(1), (2), (4) Date: Sep. 16, 2013

(87) PCT Pub. No.: WO2012/098191

PCT Pub. Date: Jul. 26, 2012

(65) Prior Publication Data

US 2014/0003619 A1 Jan. 2, 2014

(30) Foreign Application Priority Data

Jan. 19, 2011 (FR) ..... 11 50409

(51) Int. Cl.

*H04R 3/12* (2006.01)
*H04R 27/00* (2006.01)
*H04S 7/00* (2006.01)

(52) U.S. Cl.

CPC ..... *H04R 3/12* (2013.01); *H04S 7/308* (2013.01); *H04R 27/00* (2013.01);
(Continued)

(58) Field of Classification Search

CPC ..... H04R 3/12; H04R 27/00; H04R 2420/01; H04R 2420/07; H04R 2205/022;
(Continued)

(56) References Cited

U.S. PATENT DOCUMENTS 8,054,987 B2 11/2011 Seydoux
8,401,475 B2 * 3/2013 Kalanithi et al. ..... 455/41.2
(Continued)

FOREIGN PATENT DOCUMENTS

EP 1 615 464 1/2006
EP 1 784 049 5/2007
(Continued)

OTHER PUBLICATIONS

International Search Report for PCT/EP2012/050792 dated Apr. 12, 2012.

*Primary Examiner* — Davetta W Goins
*Assistant Examiner* — Daniel Sellers
(74) *Attorney, Agent, or Firm* — B. Aaron Schulman, Esq.; Stites & Harbison, PLLC

(57) ABSTRACT

The invention relates to an audio processing device (1) including:

at least one connector (2, 7), suitable for receiving data defining an input sound signal;

a processing module (5, 6) suitable for determining at least one signal intended for a loudspeaker (12, 13) as a function of said defining data, a communication module (8, 9) for communicating with at least one other audio processing device, according to claim 1;

said device being characterized in that it furthermore includes a detection module (4) suitable for detecting the proximity of another device according to claim 1 and in that the processing module is suitable for determining said signal intended for the loudspeaker as a function furthermore of a number of other detected device(s).

15 Claims, 4 Drawing Sheets

(52) U.S. Cl.
CPC .... *H04R 2205/022* (2013.01); *H04R 2420/01* (2013.01); *H04R 2420/07* (2013.01)

(58) Field of Classification Search
CPC ..... H04R 2201/40; H04R 2201/401; H04R 2201/403; H04R 2201/405; H04S 7/308
USPC ..... 381/81
See application file for complete search history.

(56) References Cited

U.S. PATENT DOCUMENTS

| | | | | |
|---|---|---|---|---|
| 2001/0011993 | A1* | 8/2001 | Saarinen | 345/156 |
| 2004/0071294 | A1* | 4/2004 | Halgas et al. | 381/59 |
| 2005/0254662 | A1* | 11/2005 | Blank et al. | 381/58 |
| 2006/0062401 | A1* | 3/2006 | Neervoort et al. | 381/82 |
| 2007/0110265 | A1* | 5/2007 | Kirkeby et al. | 381/300 |
| 2007/0211907 | A1 | 9/2007 | Eo et al. | |
| 2007/0223725 | A1 | 9/2007 | Neumann et al. | |
| 2008/0045140 | A1* | 2/2008 | Korhonen | 455/3.06 |
| 2008/0077261 | A1* | 3/2008 | Baudino et al. | 700/94 |
| 2009/0017868 | A1 | 1/2009 | Ueda et al. | |
| 2009/0081948 | A1* | 3/2009 | Banks et al. | 455/3.05 |
| 2009/0092259 | A1* | 4/2009 | Jot | H04S 3/02 381/17 |
| 2009/0110204 | A1* | 4/2009 | Walsh et al. | 381/17 |
| 2009/0150163 | A1* | 6/2009 | Martin | H04S 3/002 704/500 |
| 2009/0238372 | A1* | 9/2009 | Hsu | 381/61 |
| 2009/0323991 | A1* | 12/2009 | Hudson et al. | 381/303 |
| 2011/0002487 | A1* | 1/2011 | Panther et al. | 381/300 |
| 2011/0150247 | A1* | 6/2011 | Oliveras | 381/304 |
| 2011/0305344 | A1* | 12/2011 | Sole | G10L 19/008 381/22 |
| 2011/0316768 | A1* | 12/2011 | McRae | 345/156 |

FOREIGN PATENT DOCUMENTS

| | | |
|---|---|---|
| EP | 2 194 438 | 6/2010 |
| JP | 2009 218888 A | 9/2009 |
| WO | WO 03/053048 | 6/2003 |

* cited by examiner

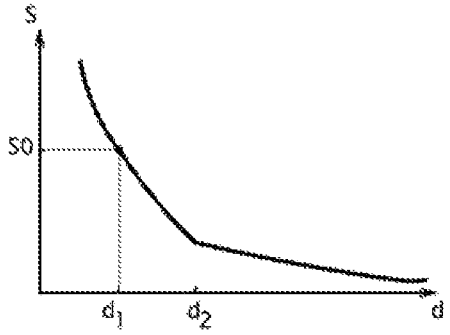
FIG.3
| | | | |
|---|---|---|---|
| 1 | 2 | 3 | 4 |
| 12 | 13 | 14 | 5 |
| 11 | 16 | 15 | 6 |
| 10 | 9 | 8 | 7 |
FIG.4
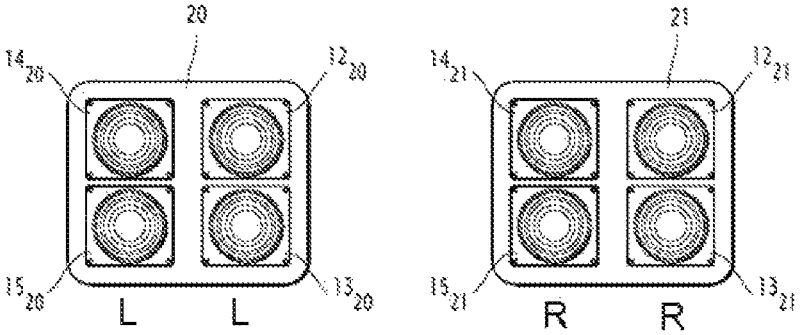
FIG.5

AUDIO PROCESSING DEVICE

The present invention relates to an audio processing device including:

at least one connector, suitable for receiving data defining an input sound signal corresponding to a plurality of audio channels;

a processing module suitable for determining at least one signal intended for a loudspeaker as a function of said defining data, the device further including a detection module suitable for detecting the proximity of another similar audio processing device and the processing module is suitable for determining said signal intended for the loudspeaker as a function furthermore of a number of other detected device(s).

Document EP 2,194,438 describes such an audio processing device, which comprises means for connecting with a portable audio device, for example an MP3 ("MPEG Audio Layer 3") reader or a computer, providing music files for example. This audio processing device is placed under a docking station having loudspeakers and performs operations on the data file such as: converting the input data into an audio signal, selecting tracks from among several tracks comprised in the audio signal, etc. It is capable, by means of a wireless connection with other audio processing devices, of having the same music played on the other loudspeakers at the same time.

The invention proposes a solution for restoring an audio signal very richly and in a more satisfactory manner using such audio processing devices.

To that end, the invention relates to an audio processing device of the aforementioned type, characterized in that said determination of the signal done by the processing module comprises:

i. selecting a channel from among a plurality of audio channels corresponding to the defining data of the input sound signal as a function of a distance between the device and another detected device; and/or ii. combining different audio channels from among a plurality of channels corresponding to the defining data of the input sound signal as a function of a distance between the device and another detected device; and/or iii. selecting frequencies of said combination.

Thus, the audio processing device adapts the content of the signal intended to be played by a loudspeaker system as a function of the number of devices detected. One such device may take full advantage of the proximity of several audio processing devices, by specializing the functionality of at least some of them based on the number thereof, automatically and so as to be able to be dynamically reconfigured as a function of the arrival or departure of the devices.

In certain embodiments, the audio processing device according to the invention further includes one or more of the following features.

The audio processing device comprises a communication module for communicating with at least one other similar audio processing device.

The communication means comprise a radio transceiver module and in which the detection module is suitable for detecting the proximity of another audio processing device if a radio signal emitted by the other processing device is received by the radio processing device at a level above a given threshold.

The processing module is suitable for determining a plurality of signals intended for respective loudspeakers, each of said signals being determined as a function of said defining data and the number of other device(s) detected.

The audio processing device comprises an audio retrieval system comprising one or more loudspeakers, each loudspeaker being suitable for receiving and restoring the determined signal for said loudspeaker by said processing module.

The processing module is further suitable for determining the signal intended for a loudspeaker of the other detected audio processing device furthermore based on the number of other detected device(s).

The detection module is furthermore suitable for estimating:

its own spatial position; and/or a rotation that it undergoes; and/or the relative spatial position of the other detected device (s); and/or the distance between the detected device and at least one other detected device;

and in which the processing module is suitable for determining the signal intended for the loudspeaker furthermore as a function of its own estimated position and/or the estimated rotation and/or said estimated relative position and/or said estimated distance.

The determination of the signal done comprises selecting frequencies, as a function of the relative positions of the device and the other detected device, of a channel or a combination of channels.

The detection module is suitable for estimating a relative height position of audio processing devices and determining the signal intended for the loudspeaker as a function of said estimated position.

The audio processing device is suitable for emitting a notification to a user when the proximity of another device is detected, and for waiting for a command from the user to determine the signal intended for the loudspeaker furthermore as a function of the number of other detected device(s).

The command corresponds to the detection by the detection module of an impact applied to the audio processing device.

The audio processing device is suitable for selecting, after detecting another nearby audio processing device, a state from among a master device state and a slave device state, a master device providing a slave device with the defining data of an input sound signal as a function of which the signal intended for a loudspeaker in the slave device will be defined.

The audio processing device is suitable for selecting a state from among a master device state and a slave device state as a function of the detection or non-detection by the detection module of the impact applied to the audio processing device.

The connector is suitable for receiving defining data of an input sound signal and is suitable for housing a source device and for interfacing with said housed source device to collect said data.

The audio processing device comprises a microphone suitable for recording the sound defined by another nearby audio processing device and means for synchronizing the signal determined by the processing module intended for a loudspeaker, as a function of the comparison between at least one portion of the recorded sound and a portion of the signal determined by the processing module intended for a loudspeaker.

The invention will be better understood upon reading the following description and examining the accompanying figures. These figures are provided as an illustration, but are non-limiting with respect to the invention. These figures are as follows:

FIG. 3 shows the curve of a signal level coming from one audio processing device and received by another audio processing device as a function of the distance separating them;

FIG. 4 is a division of a surface area in one embodiment of the invention;

FIG. 5 shows two audio processing devices in one embodiment of the invention;

FIG. 1 is a diagrammatic view of an audio processing device 1, hereafter called audio housing 1, in one embodiment of the invention.

Figure 1:
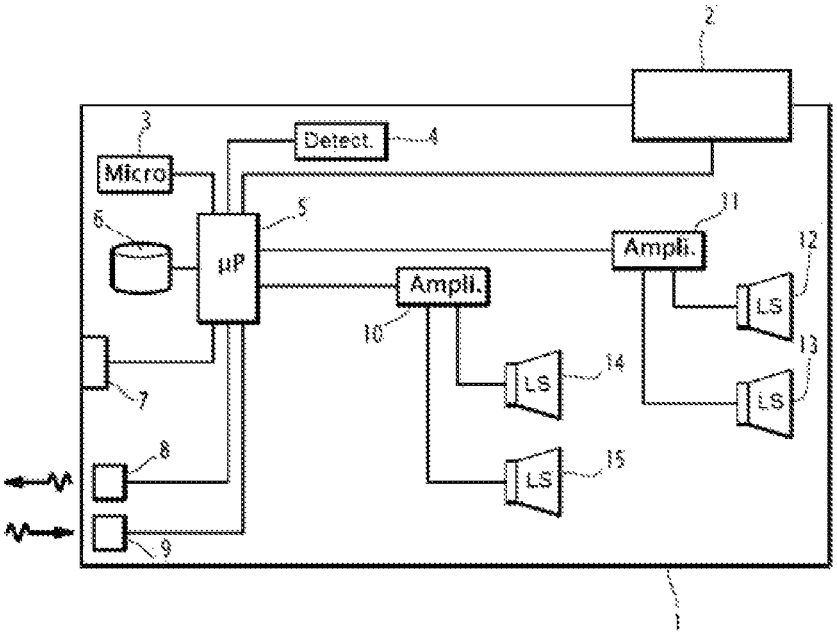
FIG. 1 is a diagrammatic view of an audio processing device in one embodiment of the invention.

The audio housing 1 includes an input connector 2 suitable for connecting to an audio data source, for example an MP3 player or a radio stream.

The audio housing 1 comprises a microphone 3, a memory area 6 for storing data and software instructions defining processing operations to be performed when they are carried out on a microprocessor, and a detection module 4.

It further includes an Internet interface 7, for example suitable for obtaining audio streams directly from the Internet.

In the described embodiment, the audio housing comprises two amplifiers 10, 11. The amplifier 10 is connected to two loudspeakers 14, 15. The amplifier 11 is connected to two loudspeakers 12, 13. The loudspeakers are for example suitable for restoring the full range of audio frequencies.

Furthermore, the audio housing 1 includes a communication module communicating with other audio housings similar to the housing 1. In the considered embodiment, this communication module comprises a radio transmitter 8 and a radio receiver 9, using technology of the Wi-Fi, Bluetooth or Zigbee type, for example, in the described case. Although wireless communication means are particularly suited to the implementation of the invention, the invention may nevertheless be implemented with wired communication means.

The audio housing 1 comprises a microprocessor 5 connected to the microphone 3, the detection module 4, the memory. 6, the input connector 2, the Internet connector 7, the radio transmitter 8, the radio receiver 9 and the amplifiers 10 and 11.

In certain embodiments, the audio housing 1 includes additional input and output connectors, of a standard or proprietary type, for connecting any type of audio source, for example mobile telephones, computers, musical instruments, etc. or peripherals, for example speaker systems.

Additional elements are included in the audio housing 1, but not shown here, such as power supply units with batteries for example and/or plugs for connecting to a power source, a user interface, in particular an ON/OFF button, etc.

The detection module 4 is designed to detect the nearby presence of another audio housing of the same type as the housing 1.

It is configured for measuring the field levels of Zigbee (or Wi-Fi or Bluetooth, etc. depending on the selected technology) signals received from other housings and comparing them to a threshold So.

The evolution of the field level received by an audio housing as a function of the distance separating it from another housing is shown in FIG. 3, in one embodiment. Thus, typically, the field level received by one housing from another housing is greater than S0 when the distance between those two housings is smaller than the distance d1.

In one embodiment, d1 corresponds to 1 meter (m); at a distance d2 equal to 3 m, a level of S0/3 is received, and a nearly nonexistent level is received at a distance of 30 m.

According to certain embodiments, d1 can assume distinct values, for example 10 cm, 20 cm, 1 m, 2 m.

When a field level received by the housing 1 is greater than S0, the housing 1 detects the presence of another housing and emits a signal intended to notify the user, for example a characteristic "BEEP". Each device emits a sound signal.

Figure 2:
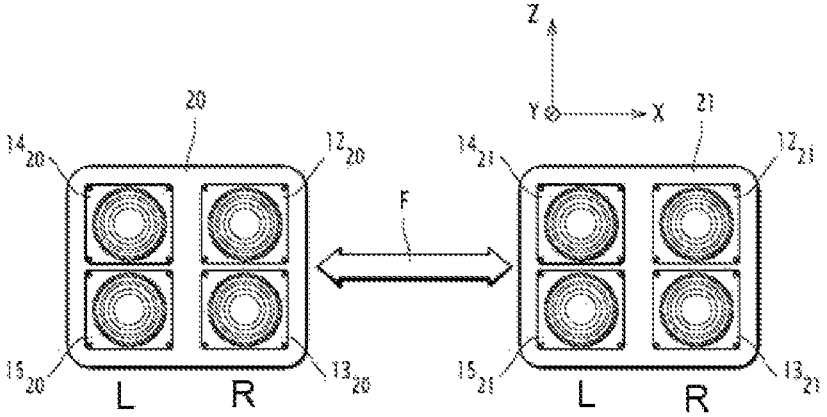
FIG. 2 is a view of the front surface of two audio processing devices in one embodiment of the invention.

The detection module 4 also includes a position sensor comprising three accelerometers that calculate the three linear accelerations along three orthogonal axes X, Y, Z. The three axes X, Y and Z are illustrated in FIG. 2 relative to the audio housing 2, similar to the housing 1. The detection module 4 is therefore capable, from the accelerations calculated by the position sensor, of determining the position of the audio housing 1 at all times, with respect to a reference position, as well as a movement and/or rotation undergone by the housing 1.

Furthermore, following the emission of a "BEEP" notification signal as indicated above, the housing 1 is suitable for waiting, following the issue of that BEEP, for a command from the user to connect with the other detected housing.

In the embodiment considered in the case at hand, the command awaited in response to the "BEEP" is an impact, of the pressing type, applied by a user on one of the two housings detected as being near one another. This pressing is detected by the housing having received it, using the accelerometers of its detection module 4.

Following reception of that pressing, the two housings are coupled and furthermore, a master housing is designated, the other being the slave housing.

Each change of position and/or orientation detected with respect to that location point by the detection means of a slave housing after coupling is sent by the Zigbee transmitter means of the slave housing to the master housing.

In the considered embodiment, the housing having received the pressing is the slave housing.

Once a master audio housing has been defined, it suffices to bring said housing close (at a distance smaller than d1) to another housing and to reiterate the aforementioned steps, i.e., pressing after detection to couple it with the master housing and to declare it an additional slave housing.

Thus, it is possible to obtain a master housing and a number n of slave housings, n being able to assume various integer values.

In one embodiment, it is also possible in the same manner to perform the coupling on any slave housing, the slave state thus being able to be given to one audio housing by another slave audio housing, which in turn has been coupled to a master housing or a housing having been coupled to the master housing.

A housing 1 is adapted so as, when it is declared master housing, to determine the audio signals intended to be provided to its loudspeakers, as well as the audio signals intended to be provided to the loudspeakers of the slave housing(s).

This determination is made as a function of the number n of slave housings and/or the distance separating the master housing from each slave housing and/or the relative positions of these housings with respect to each other.

In one embodiment, this determination is furthermore made as a function of the relative distances or positions between some or all of the housings. It is also dynamically updated as a function of any relative movements of the housings.

Each coupling corresponds to an identical location point of the master housing and slave housing that have been coupled (to within the distance d1). Each change in position and/or orientation detected with respect to that location point by the detection module of a slave housing after coupling being transmitted by the Zigbee transmission means of the slave housing to the master housing, the latter thus knows the position of each of its slave housings. For example, in one embodiment, the master housing subdivides a portion of the plane (X, Y) into a matrix of positions including a number N of distinct positions, such as the 4*4 matrix shown in FIG. 4, including 16 distinct positions numbered from 1 to 16; and assigns a position number to each housing coupled to it as well as to itself.

These determinations of signals and positions are done using software instructions stored in the memory area 6 and executed on the microprocessor 5.

FIG. 2 shows the front face of two audio housings 20, 21 of the type diagrammatically shown in FIG. 1. On each front face of each of these housings 20, 21 appear the four loudspeakers, positioned in two columns of two loudspeakers each.

Thus, in the audio housing 20, with respect to FIG. 1, the loudspeakers $\mathbf{12}_{20}$ and $\mathbf{13}_{20}$ correspondent to the loudspeakers 12, 13 and loudspeakers $\mathbf{14}_{20}$ and $\mathbf{15}_{20}$ correspondent the loudspeakers 14, 15. In the audio housing 21, the loudspeakers $\mathbf{12}_{21}$ and $\mathbf{13}_{21}$ correspond to the loudspeakers 12, 13 and the loudspeakers $\mathbf{14}_{21}$ and $\mathbf{15}_{21}$ correspond to the loudspeakers 14, 15.

An audio housing according to the invention may further include an outer handle (not shown), so as to allow easy carrying by a user.

Let us now consider the operation of a housing of the type of the housing 1 in an independent mode.

In such a case, under the control of the microprocessor 5, audio data is extracted from an audio source, for example an MP3 file of an MP3 reader connected to the connector 2 or files downloaded from the connector 7, stored in a buffer memory of the memory area 6, then processed.

The processing includes operations necessary to determine, as a function of the MP3 file, an audio signal, for example a stereo signal made up of a left channel audio signal and a right channel audio signal. The right channel audio signal is sent to the amplifier 11, which amplifies it before transmitting the resulting signal to the loudspeakers 12 and 13, which produce sounds corresponding to the signal of the right channel R. Similarly, the left channel signal is transmitted to the amplifier 10, which amplifies it before transmitting the resulting signal to the loudspeakers 14 and 15, which produce sounds corresponding to the signal of the left channel L.

In one embodiment, each of the amplifiers 10, 11 is connected to the set of loudspeakers 12, 13, 14, 15 and the selection of the loudspeakers actually powered by each amplifier 10, 11 depends on the spatial position of the audio housing 1, in terms of rotation, orientation and/or tilting in space.

Figure 8:
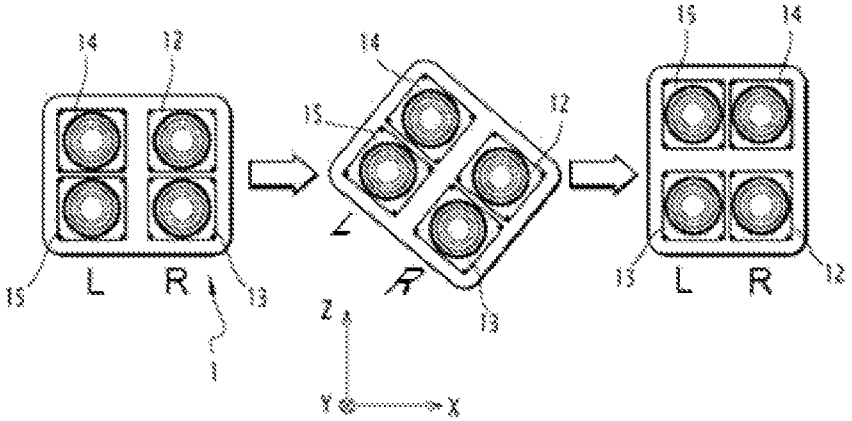
FIG. 8 shows a view of a housing undergoing a change in position in one embodiment of the invention.
Figure 9:
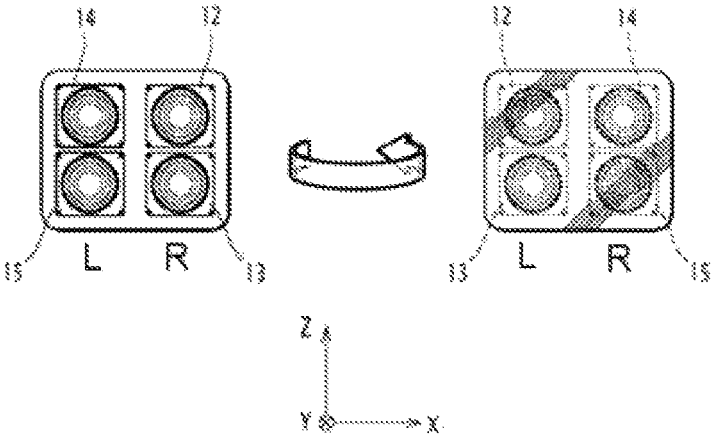
FIG. 9 shows a view of a housing undergoing a change of position in one embodiment of the invention.

Thus, the housing 1 adapts its behavior to its own position, determined using its detection module 4. For example, in reference to FIG. 8, the initial position being that shown on the left and described above, if the housing is tilted 90° to the right (rotation around the axis Y, intermediate position shown in the middle, final position shown on the right), it is designed to play the left channel L (provided by the amplifier 10) on the loudspeakers 13 and 15 and the right channel R (provided by the amplifier 11) on the loudspeakers 12 and 14. Likewise, as shown in FIG. 9, the initial position being that shown on the left with a view of the front face of the loudspeakers, if the housing is pivoted horizontally 180° around the axis Z, the housing 1 reverses the right and left channels. In the arrival position shown on the right, with a view of the rear face, the loudspeakers 12, 13 broadcast the left channel coming from the amplifier 10 and the loudspeakers 14, 15 broadcast the right channel (R) coming from the amplifier 11.

If the MP3 file defines a signal 5.1 or 7.1, the left channel and right channel signals are extracted therefrom.

It will be noted that if the MP3 file does not define a stereo signal, but a mono signal, depending on the case, that same mono signal is transmitted to the amplifiers 10, 11, or in certain cases, processing is applied by the microprocessor 5 to provide stereo output, resulting in a distinct signal for each of the amplifiers 10, 11.

Let us consider that the two audio housings 20 and 21 both operate in independent mode as described above.

Thus, the loudspeakers $\mathbf{12}_{20}$ and $\mathbf{13}_{20}$ produce sounds corresponding to the right channel signal of a given audio file used as input at a connector 2 or 7 of the audio housing 20, and the loudspeakers $\mathbf{12}_{21}$ and $\mathbf{13}_{21}$ produce sounds corresponding to the right channel signal of a given audio file used as input at a connector 2 or 7 of the audio housing 21 (see "R" in FIG. 2). The loudspeakers $\mathbf{14}_{20}$ and $\mathbf{15}_{20}$ produce sounds corresponding to the left channel signal of the audio file provided as input of the audio housing 20, while loudspeakers $\mathbf{14}_{21}$ and $\mathbf{15}_{21}$ produce sounds corresponding to the left channel signal of the audio file provided as input of the audio housing 21 (see "L" in FIG. 2).

Let us consider that these audio housings 20, 21 are now brought closer to each other (for example, the user of one of the housings brings it closer to the other) at a distance from each other smaller than d1 so as to couple them, as indicated by the arrow F illustrated in FIG. 2.

Each of them will then detect, using their respective detection module, that another housing is thereby. Consequently, they then transmit the characteristic "BEEP" signal intended to notify a user. The user presses on the audio housing 21. The two audio housings 20 and 21 are now coupled, the housing 20 being the master housing and the housing 21 being the slave housing.

The master housing 20 determines, from the audio file given to it as input via its connector 2 or 7, the audio signals to be restored by each housing 20, 21.

As long as the housings 20, 21 are very close to each other (for example, at a distance from each other smaller than a threshold value D (for example equal to d1)), they will play the same stereo sounds.

The defining data of the right channel signal and left channel signal determined by the housing 20 from the sound data received by its input connector 2 or 7 are transmitted to the housing 21 by the Zigbee communication means.

The housing 21 then stops the previous production of stereo sounds coming from data received on its own input connectors 2, 7. The right channel signals received are transmitted via an amplifier of the housing 21 to the loudspeakers $\mathbf{12}_{21}$, $\mathbf{13}_{21}$ of the housing 21, while the left channel signals are transmitted via an amplifier of the housing 21 to the loudspeakers $\mathbf{14}_{21}$ and $\mathbf{15}_{21}$.

In the housing 20, as in the case where it was operating in the independent mode, the loudspeakers $\mathbf{12}_{20}$ and $\mathbf{13}_{20}$ produce sounds corresponding to the right channel signal and the loudspeakers $\mathbf{14}_{20}$ and $\mathbf{15}_{20}$ produce sounds corresponding to the left channel signal of the audio signal received at a connector 2, 7 of the housing 20.

The two housings 20, 21 therefore transmit the same music, each plays in stereo, and the sound power increases.

Next, the housings 20, 21 are gradually moved away from each other by a user up to a distance from each other greater than the threshold value D (for example, equal to d1), but still within their mutual Zigbee coverage area.

Following the coupling that took place between the housings 20 and 21, the master housing 20 is informed of changes in position and distance between the housings 20, 21.

The master housing 20 successively determines the relative position.

The master housing 20 then dynamically adapts, following the relative movement of the two housings 20, 21, the audio signals to be restored by each housing 20, 21.

At the end of the movement, in the position matrix shown in FIG. 4, the housing 20 is in position 8, while the housing 21 is in position 12.

In one embodiment, as long as the distance separating them is smaller than the threshold distance D, the two housings 20, 21 continue to transmit the same music, each in stereo.

Once it is determined by the master housing 20 that the distance separating them is greater than the threshold D, the left channel signal of the audio file coming from a connector 2 or 7 of the master housing 20 is provided to all of the loudspeakers of that among the audio housings 20, 21 situated on the user's left facing the loudspeakers (in the case at hand, the loudspeakers $\mathbf{12}_{20}$, $\mathbf{13}_{20}$, $\mathbf{14}_{20}$ and $\mathbf{15}_{20}$ of the housing 20), while the right channel signal of the audio file is provided to all of the loudspeakers of the other audio housing 20, 21 (in the case at hand, the loudspeakers $\mathbf{12}_{21}$, $\mathbf{13}_{21}$, $\mathbf{14}_{21}$ and $\mathbf{15}_{21}$ of the housing 21), as shown in FIG. 5.

Each housing then plays the same mono channel over all of its speakers.

Thus, the spatial output of the sound is amplified. The invention makes it possible to specialize the function of each of the coupled audio housings as a function of their relative position.

It is the knowledge of each of the movements of the coupled audio housings that allows the master audio housing to determine which housing will play the left channel and which housing will play the right channel.

Figure 6:
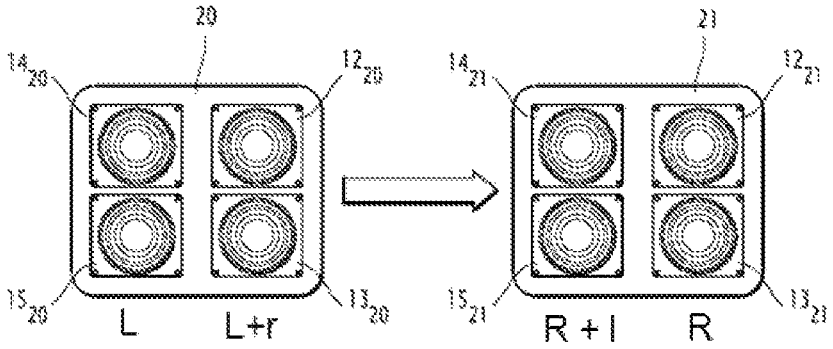
FIG. 6 shows two audio processing devices in one embodiment of the invention.

In another embodiment, the transition of the broadcast from the stereo signal to a mono signal in each of the housings 20, 21 occurs gradually over the course of the relative movement of the housings, under the control of the master housing 20. For example, the housing 20, situated on the left, plays the left channel signal on the loudspeakers $\mathbf{14}_{20}$ and $\mathbf{15}_{20}$ situated on the left, and the left channel signal mixed with the right channel signal (L+r) on the loudspeakers $\mathbf{12}_{20}$ and $\mathbf{13}_{20}$ situated on the right, while the housing 21, situated on the right, plays the left channel signal mixed with the right channel signal (R+I) on the loudspeakers $\mathbf{14}_{21}$ and $\mathbf{15}_{21}$ situated on the left, and the right channel signal on the loudspeakers $\mathbf{12}_{21}$ and $\mathbf{13}_{21}$ situated on the right, as shown in FIG. 6.

The mixing gradually decreases over the course of the movement until the distance D is crossed.

Thus, during the movement, the spatial output of the sound is optimized as a function of the movement.

In one embodiment, three additional slave audio housings are next coupled with the master audio housing 20. After coupling, they are for example placed in positions 2, 6 and 16 of the position matrix shown in FIG. 4. They are therefore added to the housings 20 and 21 that are in positions 8 and 12.

In this embodiment, the master housing 20 is suitable for determining a signal to be restored by its own loudspeakers, and a signal to be restored by the loudspeakers of each of the N=4 slave housings as a function of that number N.

In the case at hand, under the control of the master housing 20, each housing is selectively allocated to a channel of the configuration 5.1 of the input audio file of the master housing 20, each housing then being specialized in playing the role of a dedicated enclosure of a system 5.1. The played channels are distinct from one another.

In one embodiment, which may or may not be combined with the specializations described above as a function of the position or distance, a specialization relative to frequencies is controlled by the master housing as a function of the relative positions of the housings, for example along the axis Z and/or as a function of the distances between the housings.

Figure 7:
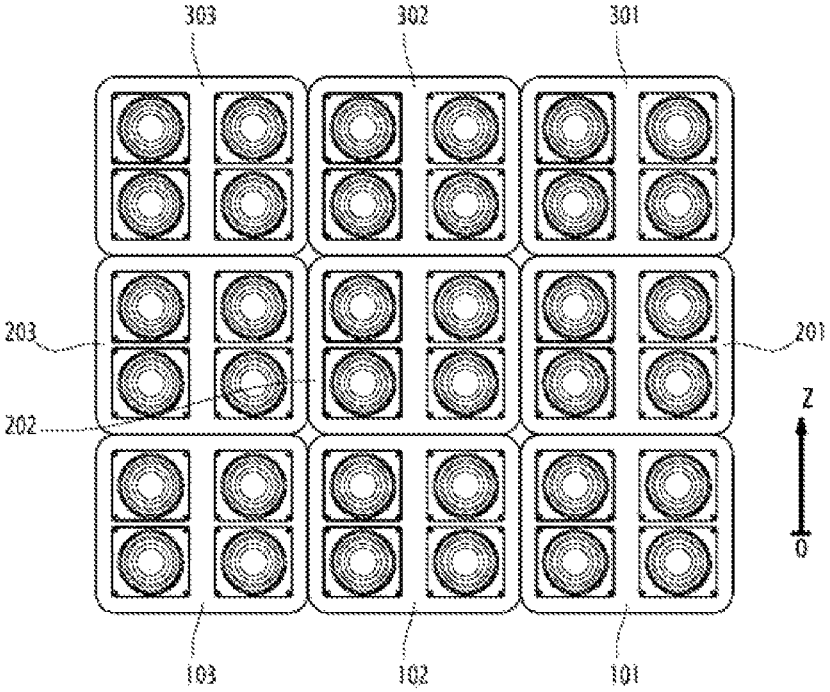
FIG. 7 is a view of the front face of a wall of audio processing devices in one embodiment of the invention.

Indeed, the master housing knows the positions of the different slave housings coupled to it. In one embodiment, it may control the housings of a wall made up of housings as shown in FIG. 7 (in the illustrated case, including nine housings), such that the loudspeakers of all of the housings broadcast the bass of a sound signal, the loudspeakers of the lower housings 101, 102, 103 exclusively broadcast bass, the loudspeakers of the intermediate housings 201, 202, 203 only broadcast bass and mid-range sound, and the loudspeakers of the upper housings 301, 302, 303 only broadcast bass and treble.

In one embodiment, to avoid any dissonance, the housings synchronize themselves, using their respective microphones 3 so as to offset any processing and/or transmission latencies. Certain portions of the audio signal such as the bass are not lateralized and are therefore present in all of the coupled housings, even when they are specialized according to the invention. These portions transmitted from the loudspeakers of other housings are recorded by the microphone of each considered housing and allow recalibration by comparison (for example by intercorrelation between the two portions) between a portion picked up using the microphone and the corresponding portion played by the considered housing.

According to the embodiments of the invention, the adaptation of the audio functionality of the housing (by dynamic allocation of a dedicated channel, by combining several channels and/or frequency-related specialization) is done as a function of a factor or a combination of several factors among the number of nearby housings, the distance between the housings, the relative positioning, in particular heightwise, of the housings, etc.

In the embodiment described in reference to the figures, the audio processing device 1 integrates four loudspeakers and two amplifiers. However, in other embodiments, an audio processing device according to the invention includes any whole number of amplifiers and/or loudspeakers, which may in particular be zero. When the audio processing device according to the invention does not include integrated loudspeakers, it delivers, across output terminals, the signals intended for loudspeakers. These signals are next provided to input terminals of one or more loudspeakers of an external base associated with the audio processing device. The external base is connected to the audio processing device by a direct connection (for example, the device clips into a housing of the external base), which may be wired or wireless.

In one such embodiment in particular, the audio processing device may be an external removable device such as an iPod or iPhone, which has the necessary detection devices, antenna and microphone and is commanded by a software application, which may for example be downloadable. The processing operations described above and done by the microprocessor 5 to carry out the invention so as to adapt the audio signals played by the different loudspeakers are then defined by software instructions of the application.

Thus, two or more mobile telephones having downloaded this application and equipped with a microphone, a microprocessor, an antenna and a detection device can then be coupled and have two external bases play even though they have different signals (right and left) according to the invention.

In the described embodiment, the processing for determining the audio signals to be played by the master housing and the slave housing(s) is done in the master housing. In another embodiment, the housings are suitable for operating in cooperative mode, in which the processing operations are shared between the different coupled housings.

In one embodiment, the position sensor for example comprises six accelerators (inertial unit), or three accelerometers and a compass.

In one embodiment, the position sensor with accelerometers of an audio housing is replaced by a position sensor using other technologies making it possible to determine the position and movements (rotation in space, translation) for example by analyzing sounds emitted by the housings.

Thus, the present invention proposes a housing suitable for specializing and/or adapting its audio restoration functionality in terms of type of channel played from among several channels of the audio signal to be played or frequency range, and if applicable to specialize and/or adapt the functionality of other housings situated nearby, depending on the number of those housings and/or their respective positions. These arrangements make it possible to best dynamically use the groupings and movements of portable housings, in particular within a same residence.

The invention claimed is:

1. An audio processing device comprising:

at least one connector that receives data defining an input sound signal corresponding to a plurality of audio channels;

a processing module that determines at least one signal intended for a loudspeaker as a function of said defining data, and a detection module that detects the proximity of another audio processing device, wherein the processing module is capable of determining said signal intended for the loudspeaker as a function of a number of other detected device(s); and wherein said determining of the signal by the processing module comprises:

i selecting a channel from a plurality of audio channels corresponding to the defining data of the input sound signal as a function of an absolute distance between the device and another detected device compared to a distance threshold;

ii combining different audio channels from a plurality of channels corresponding to the defining data of the input sound signal as a function of an absolute distance between the device and another detected device compared to a distance threshold; and iii selecting frequencies of a combination of different audio channels from a plurality of channels corresponding to the defining data of the input sound signal as a function of an absolute distance between the device and another detected device compared to a distance threshold, and wherein the audio processing device further comprises an audio retrieval system comprising one or more loudspeakers, each loudspeaker capable of receiving and restoring the determined signal for said loudspeaker by said processing module.

2. An audio processing device according to claim 1, comprising a communication module for communicating with at least one other audio processing device, according to claim 1.

3. The audio processing device according to claim 2, wherein the communication means comprise a radio transceiver module and in which the detection module detects the proximity of another audio processing device if a radio signal emitted by the other processing device is received by the radio processing device at a level above a given threshold.

4. The audio processing device according to claim 1, wherein the processing module is determines a plurality of signals intended for respective loudspeakers, each of said signals being determined as a function of said defining data and the number of other device(s) detected.

5. The audio processing device according to claim 1, wherein the processing module further determines the signal intended for a loudspeaker of the other detected audio processing device as a function furthermore of the number of other detected device(s).

6. The audio processing device according to claim 1, wherein the detection module also estimates:

its own spatial position; and/or a rotation that it undergoes; and/or the relative spatial position of the other detected device (s); and/or the distance between the detected device and at least one other detected device;

and in which the processing module determines the signal intended for the loudspeaker furthermore as a function of its own estimated position and/or the estimated rotation and/or said estimated relative position and/or said estimated distance.

7. The audio processing device according to claim 1, wherein said determination of the signal comprises selecting frequencies, as a function of the relative positions of the device and the other detected device, of a channel or of a combination of channels.

8. The audio processing device according to claim 1, wherein the detection module estimates a relative height position of audio processing devices and determines the signal intended for the loudspeaker as a function of said estimated position.

9. The audio processing device according to claim 1, wherein the audio processing device emits a notification to a user when the proximity of another device is detected, and for waiting for a command from the user to determine the signal intended for the loudspeaker furthermore as a function of a number of other detected device(s).

10. The audio processing device according to claim 9, wherein the command corresponds to the detection by the detection module of an impact applied to the audio processing device.

11. The audio processing device according to claim 1, wherein, after detecting another nearby audio processing device, the device selects a state from among a master device state and a slave device state, a master device providing a slave device with the defining data of an input sound signal as a function of which the signal intended for a loudspeaker in the slave device will be defined.

12. The audio processing device according to claim 11, wherein the device selects a state selected from the group consisting of a master device state and a slave device state as a function of the detection or non-detection by the detection module of an impact applied to the audio processing device.

13. The audio processing device according to claim 1, wherein the connector houses a source device and for interfacing with said housed source device to collect said data.

14. The audio processing device according to claim 1, wherein the audio processing device comprises a microphone that records the sound defined by another nearby audio processing device and means for synchronizing the signal determined by the processing module intended for a loudspeaker, as a function of the comparison between at least one portion of the recorded sound and a portion of the signal determined by the processing module intended for a loudspeaker.

15. An audio processing device comprising:

at least one connector that receives data defining an input sound signal corresponding to a plurality of audio channels;

a processing module that determines at least one signal intended for a loudspeaker as a function of said defining data, wherein the device further comprises a detection module that detects the proximity of another similar audio processing device, and the processing module determines said signal intended for the loudspeaker as a function furthermore of a number of other detected device(s); wherein said determination of the signal done by the processing module comprises:

i selecting a channel from among a plurality of audio channels corresponding to the defining data of the input sound signal as a function of an absolute distance between the device and another detected device compared to a distance threshold; and/or ii combining different audio channels from among a plurality of channels corresponding to the defining data of the input sound signal as a function of an absolute distance between the device and another detected device compared to a distance threshold; and/or iii selecting frequencies of said combination;

wherein the detection module estimates a relative height position of audio processing devices and determining the signal intended for the loudspeaker as a function of said estimated position.

* * * * *